United States Patent [19]

Bryan

[11] Patent Number: 5,022,706

[45] Date of Patent: Jun. 11, 1991

[54] ADJUSTABLE KEYBOARD CHAIR

[76] Inventor: Jed A. Bryan, 188 Linde Cir., Marina, Calif. 93933

[21] Appl. No.: 523,617

[22] Filed: May 14, 1990

[51] Int. Cl.[5] ..... A47B 39/00

[52] U.S. Cl. ..... 297/162; 297/145; 297/194

[58] Field of Search ..... 297/115-117, 297/144, 145, 148-155, 160-162, 194, 217, 417, 411, 188

[56] References Cited

U.S. PATENT DOCUMENTS

| | | | |
|---|---|---|---|
| 171,528 | 12/1875 | Musser | 257/162 |
| 258,354 | 5/1882 | Bell | 297/162 |
| 529,380 | 11/1894 | Halliburton | 297/194 |
| 1,869,444 | 8/1932 | Tobey . | |
| 2,494,838 | 1/1950 | Slaughter . | |
| 3,408,104 | 10/1968 | Raynes . | |
| 3,606,449 | 9/1971 | Whybrew et al. | 297/115 |
| 3,675,968 | 7/1972 | Douglas . | |
| 3,968,992 | 7/1976 | Hogan . | |
| 4,046,419 | 9/1977 | Schmitt . | |
| 4,779,884 | 10/1988 | Minati | 297/155 |
| 4,779,922 | 10/1988 | Cooper | 297/188 |
| 4,925,240 | 5/1990 | Peters | 297/161 |
| 4,944,552 | 7/1990 | Harris | 297/145 |

FOREIGN PATENT DOCUMENTS

| | | | |
|---|---|---|---|
| 251643 | 1/1988 | European Pat. Off. | 297/217 |
| 1600744 | 10/1981 | United Kingdom | 297/145 |

*Primary Examiner*—Kenneth J. Dorner
*Assistant Examiner*—J. Gardner
*Attorney, Agent, or Firm*—Schroeder, Davis & Orliss

[57] ABSTRACT

Support tables suitable for supporting a computer keyboard in front of a user and adapted for rotatable attachment to the side arms of a chair are provided. Each support table is hingedly attached to the front of each side arm so as to be pivotable about each of two orthogonal axes. The support tables are foldable from a generally horizontal position disposed above the seat of the chair and in front of the chair side arms and the user to a stored position disposed adjacent the outside sides the chair and side arms when the support tables are not in use.

18 Claims, 6 Drawing Sheets

ADJUSTABLE KEYBOARD CHAIR

BACKGROUND OF THE INVENTION

The present invention relates to adjustable chairs and more specifically to adjustable chairs which are adapted with foldable tables to provide a user with support for a computer keyboard, means providing mobility and multiple adjustments providing user comfort for use over an extended time with computer terminals.

The desktop or personal computer has become a common item in many homes, offices, laboratories and other work places. The customary computer arrangement is to have the entry keyboard collocated with the video display monitor, central processor and the printer. This arrangement positions the user in front of the computer monitor for ease of viewing the material being entered into the computer. In many cases, a computer table or stand is utilized to group together the related equipment, further limiting the user as to where the keyboard is placed in relation to the monitor. In order to use the computer the user sits on a chair at the keyboard in front of the monitor. This arrangement limits the user's mobility and ability to assume varying postures to relieve the strain of long hours of computer use. Several products have recently been introduced in an attempt to provide the user with more flexibility while using the computer. For example, lap keyboard pads have been developed that allow the keyboard to be held on the user's lap thus providing some flexibility of movement, but they do not allow users to maintain optimum keyboard and arm position for comfort, speed and accuracy. Also available is a stool that requires the user to take a kneeling position in front of the monitor in an attempt to attain comfortable posture. This device tires the user after a relatively short period of use as it is not designed to support the torso, nor is its unconventional appearance readily accepted in the work place. Typing manuals stress that good posture is essential for speed and accuracy and a properly designed chair contributes to attaining and sustaining the correct posture over extended time periods.

Typically, prior art chairs including a relatively small table or planar support surface mounted on one or both arms were designed for note-taking and similar activities in classroom or conference room settings and draw to some extent upon past efforts to combine desks and chairs to obtain the benefits of the former for use with the latter. U.S. Pat. No. 2,494,838 issued Jan. 17, 1950 to John R. Slaughter discloses the addition of folding tables to the arms of a chair to provide the user with a table surface upon which items may be placed. Slaughter discloses tables which fold outwardly from the arm so as to allow the occupant to egress the chair without restoring the tables to their folded position. Slaughter does not disclose nor teach apparatus for adjustment of the chair to fit the dimensions of the occupant. U.S. Pat. No. 1,869,444 issued Aug. 2, 1932 to Fred W. Tobey describes a chair with a foldable, collapsible table adapted to be concealed while not in use. Tobey further discloses an adjustment means so that the user can vary the distance that the table extends in front of the chair arm to achieve a comfortable writing posture. The apparatus disclosed by Tobey is confined to either of the sides of the chair, not providing for support of a writing surface directly in front of the occupant. Further, Tobey does not provide for adjustment to specifically conform the chair to the dimensions or convenience of the user. U.S. Pat. No. 3,408,104 issued Oct. 29, 1968 to Burt F. Raynes discloses a combined conference chair writing table arrangement for office use. Raynes combines a conventional caster supported executive chair with fixed sidearms and a cantilevered writing pad affixed to either arm so that it can be either brought into use or stored at the convenience of the user. Raynes provides for lateral adjustment of the writing surface to accommodate the needs of the user but provides only limited individual adjustment of the chair to accommodate individual user requirements.

U.S. Pat. No. 3,675,968 issued July 11, 1972 to James B. Douglas discloses a hinging attachment means for connecting a folding writing surface to a chair arm. Douglas provides for a simple, durable mechanism suitable for use in lecture halls where the user may choose to use the writing surface or not. Douglas provides no teaching of adjustment means for adapting the seating-writing combination for individual users. U.S. Pat. No. 3,968,992 issued July 13, 1976 to Gerard T. Hogan discloses a detachable writing surface for use in aircraft where limited space and excessive movement require careful control of objects such as log books and navigation maps. Hogan discloses limited adjustment means for positioning the writing surface relative to the user but no adjustment to accommodate individual users. U.S. Pat. No. 4,046,419 issued Sept. 6, 1977 to Karl Schmit discloses a rail-mounted chair with adjustment means to accommodate an individual user's position and attitude in front of a desk or worktable. Schmitt further discloses moveable armrests with a detachable flat worktable which can be positioned in front of the occupant. Schmitt teaches the use of a rail and roller means to provide ease of adjustment of distance from the work station. This same rail means severely limits the extent of movement available to the user.

Each of the U.S. Patents discussed hereinabove attempts to place a work surface conveniently arranged for a chair occupant but compromises between proper positioning and ease of storing the work surface out of the way when it is not needed. Further, the work surface is biased for either a left or right handed user. A computer operator, however, typically uses both hands and requires a work surface placed directly in front of him or her for optimum comfort over extended time periods of computer use.

SUMMARY OF THE INVENTION

An adjustable computer user's chair designed according to the principles of the present invention allows a user to place a computer keyboard directly in front of the user on foldaway support tables affixed to the chair arms. These fold away tables are adapted to be affixed to the ends of both arms of a chair so that a computer keyboard may be supported thereon. The foldaway tables may be either permanently or removably attached at the discretion of the manufacturer by selection of suitable attachment means. The tables are foldably attached so that the user can elect their use or conveniently store them to allow for other uses of the chair. The fold away feature of the keyboard table allows for rapid and easy transition from computer input work to desk tasks, for example. The chair may be equipped with casters so that the user may move to either side or away from a computer monitor. A chair supported keyboard would allow users to assume a convenient distance from the monitor screen. Such a chair supported keyboard would further allow freedom of movement at any angle from the computer monitor while maintaining optimum keyboard position, thus allowing more flexible typing control. The ability to move away from the monitor while retaining keyboard position allows for student-teacher situations wherein the student requires access to the monitor while the teacher requires access to the keyboard. The chair supported keyboard further allows movement to a nearby desk or table for consulation or to view needed material while retaining keyboard access. If the computer system is equipped with a remote sensing link between the keyboard and the central processor, a moveable keyboard equipped chair would allow the user to be stationed anywhere within range of the remote sensing link and continue to operate the computer.

The adjustable keyboard chair of the present invention may be adapted to an office style arm chair with adjustable arms which allows users to position a computer keyboard at variable height and distance directly in front of the user rather than on a desk or stand in front of the computer monitor as is the current practice. The adaptation of the present invention to a chair with multiple adjustment capability of the chair dimensions allows the user to tailor the chair for individual preference for posture and optimum comfort, thereby greatly extending the time the user can work without becoming unduly fatigued. As more and more home, office and school tasks come to be performed on the personal computer, this extension of the work period will become more significant. Further, the keyboard chair is adaptable for use with any standard keyboard or other input device, e.g., a mouse, utilized in a desktop personal computer, minicomputer or mainframe computer system.

DESCRIPTION OF THE DRAWING

For fuller understanding of the present invention, reference is made to the accompanying drawing in the following Detailed Description Of The Preferred Embodiment of the invention. In the drawing.

DETAILED DESCRIPTION OF THE PREFERRED EMBODIMENT

Figure 1:
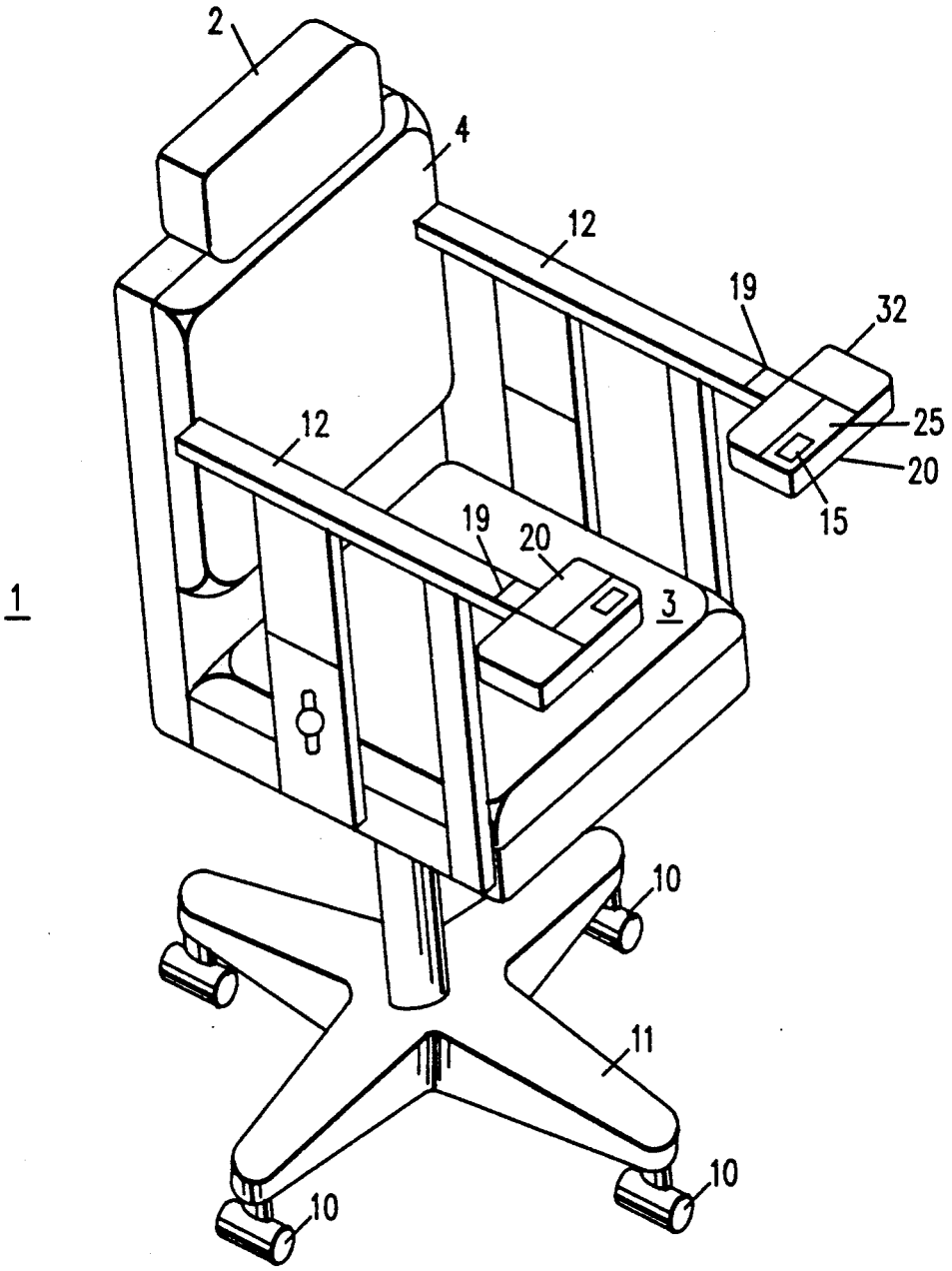
FIG. 1 is a perspective view of the adjustable keyboard chair constructed in accordance with the present invention.
Figure 2:
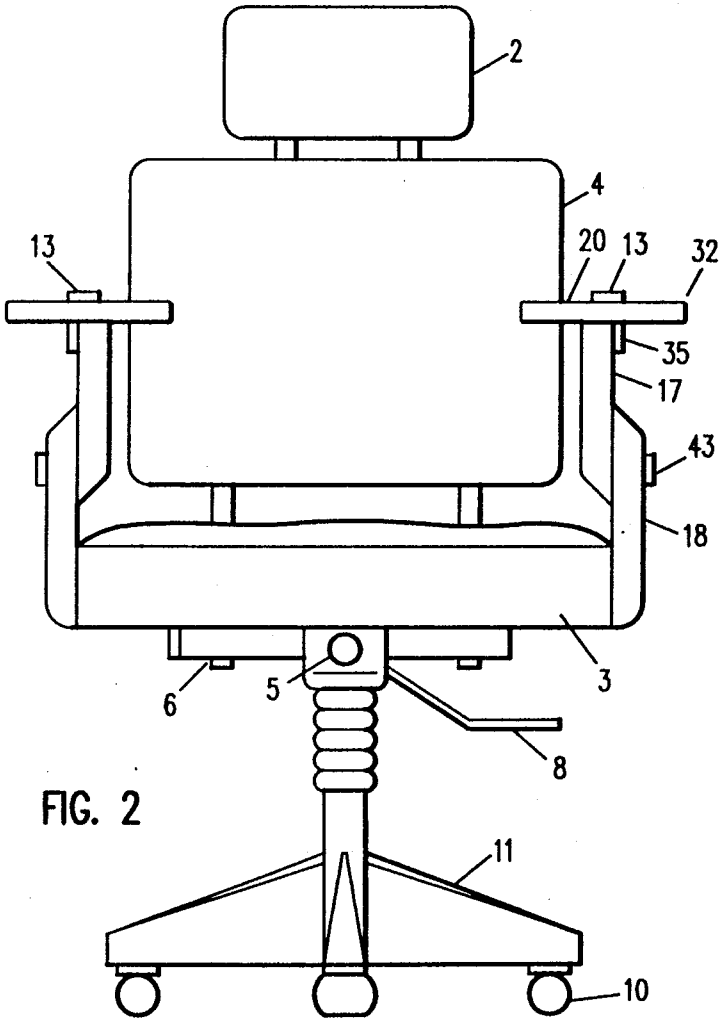
FIG. 2 is a front view of the adjustable keyboard chair shown in FIG. 1.
Figure 3:
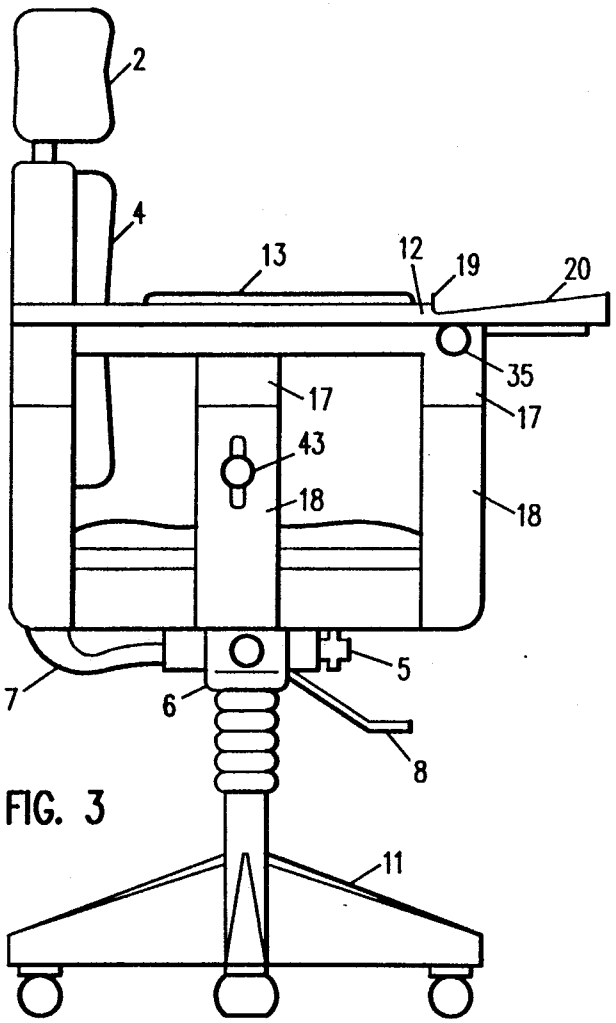
FIG. 3 is a right side view of the adjustable keyboard chair shown in FIG. 1.

Referring now to FIGS. 1–3, an adjustable keyboard chair 1 constructed according to the principles of the present invention is shown. The preferred embodiment is shown affixed to and in combination with a conventional executive style office chair, but the present invention may be utilized in conjunction with any chair which has rigid side arms. Side arms 12 provide support for the user's arms and serves as the attachment point for keyboard tables 20. The keyboard table 20 is wedge-shaped in cross section thereby providing slightly inclined upper or top surface allowing the lower or, relative to the keyboard chair 1, inwardly facing edge of a computer keyboard (not shown) to rest against shoulder or keyboard stops 19. The keyboard tables 20 are hingeably mounted at the ends of the chair arms 12 and extend inwardly towards one another in spaced relationship forming a gap therebetween. A computer keyboard (not shown) supported by the keyboard tables 20 bridges the gap therebetween and is positioned in front of a user occupying the chair 1. Keyboard stops 19 incised in the upper surface of arms 12 and are contoured to match the inclination angle of angled keyboard table 20 so as to provide a linear alignment. In use the angled keyboard table 20 is raised to the position shown in FIGS. 1 and 3 and held in place by any suitable supporting means such as a keyboard table-arm hinge 23 (as shown in FIG. 5) described hereinafter.

A conventional, wide stance base 11 is supported by caster feet 10 at the extremity of each leg. Chair base 11 may be of three, four or five leg style or may comprise curved members (not shown) providing a rocking chair without deviating from the present invention. Chair base 11 is preferentially as wide as the chair 1 to provide stability. Caster feet 10 may be either ball, wheel or cylinder style and of sufficient size to easily roll over carpet or carpet protectors (not shown) commonly found in the office or work places. Tiltback chair base 6 may be of any suitable design known in the art which provides for chair rock-back movement. Chair tiltback mechanism 6 is attached to chair base 11 by height adjustment means 8 and may be any of several suitable designs well-known in the art. Seat height adjustment means 8 may be pneumatic, as indicated in the drawing or of the screw and nut style as is well-known in the art. Chair tiltback mechanism 6 is equipped with seat back angle adjustment 5 which will be further described hereinafter. Arm support lower member 18 is rigidly attached to the chair seat frame 3 arm represents four similar pieces, two on each side as is shown in FIG. 3. Arm support upper member 17 is adjustably attached to the arm support lower member 18 by height adjustment means which will be further described hereinafter. Arm length adjustment means will also be described hereinafter. The chair seat frame 3, back 4 and arms 12 may be upholstered (as shown in FIGS. 1–3) in any convenient manner, such as with vinyl covered foam rubber pads 13, or may be left unpadded if desired. The foam rubber pads 13 may be covered with a textured, nonslip material to provide padding and support for a user's elbows and lower arms while minimizing slippage of the arms thereby providing a more relaxed posture for the user. Adjustable headrest 2 is upholstered and provided with height adjustment means in any convenient manner as is known in the art.

Figure 4:
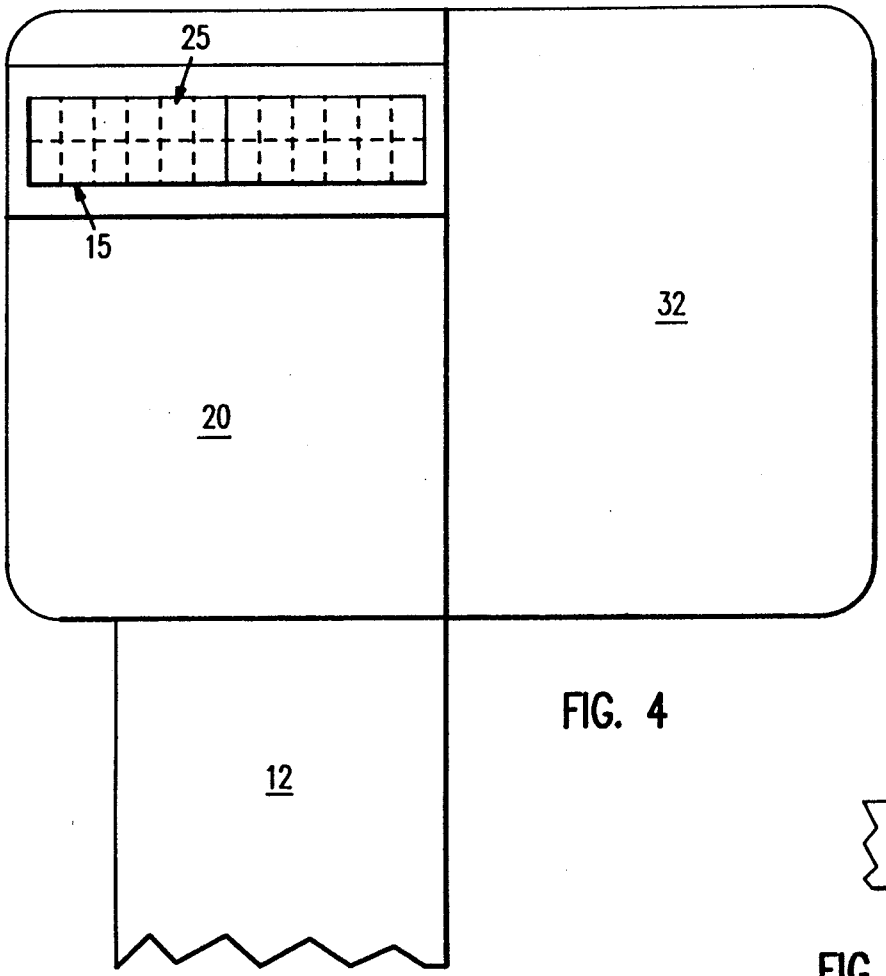
FIG. 4 is a top plan view of the keyboard table and optional mouse extension extended in place on the end of the right arm of a chair constructed in accordance with the present invention.

Referring now to FIG. 4 angled keyboard table 20 is shown in top plan view extended from arm 12 in the upright and ready to use position. Optional mouse table 32 is hingedly attached to the angled keyboard table 20 at the outside edge of either or both keyboard support tables 20. Angled keyboard table 20 and mouse table 32 may be constructed of any suitable material which coordinates with the design of the chair, such as metal or wood covered with plastic laminate for durability, for example. Grip strip 25 is a nonslip rubber-like material or other suitable material which helps to restrain the key board on the tables 20 as positioned by the user. For example, grip strip 25 may be a foam rubber sheet or pad treated with an antistatic agent and disposed across the width of the keyboard table 20 adjacent its forward edge. Incremental keyboard foot punchouts 15 are positioned at the proper distance from a corresponding incremental keyboard foot punchout 15 in the grip strip 25 on the keyboard table on the other chair arm to hold a computer keyboard in a bridge like fashion in front of the occupant of the chair. Placing the feet of the keyboard to be used in the keyboard foot punchouts 15 secures the keyboard from inadvertent dislodgment. Grip strip 25 may altenatively be a piece of adhesive material or fastening material such as VELCRO material with the opposite attaching VELCRO material affixed to the keyboard.

Figure 5C:
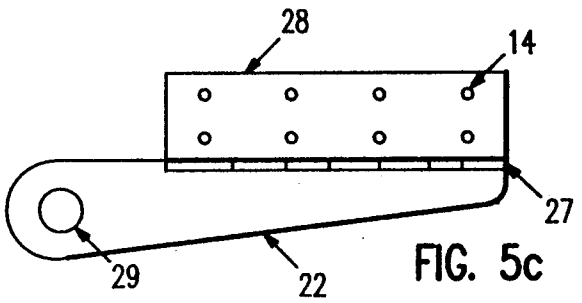
FIGS. 5A, 5B and 5C are a parts detail of a hinge means for affixing the keyboard table of the present invention.
Figure 5B:
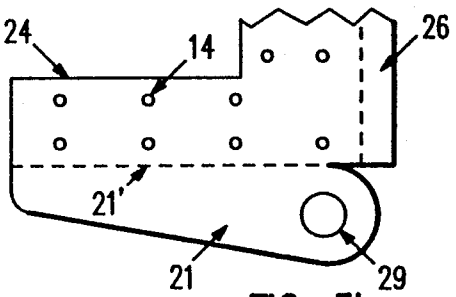
Figure 5A:
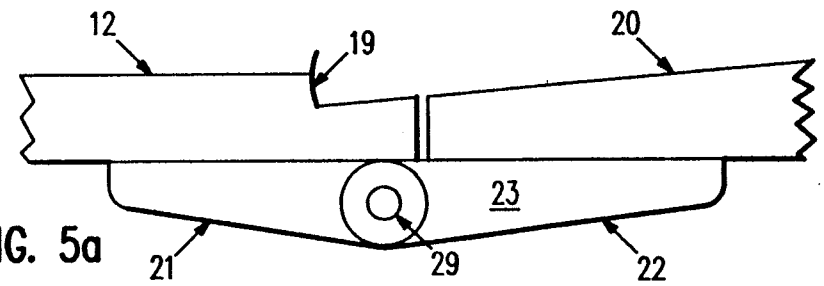
Figure 6:
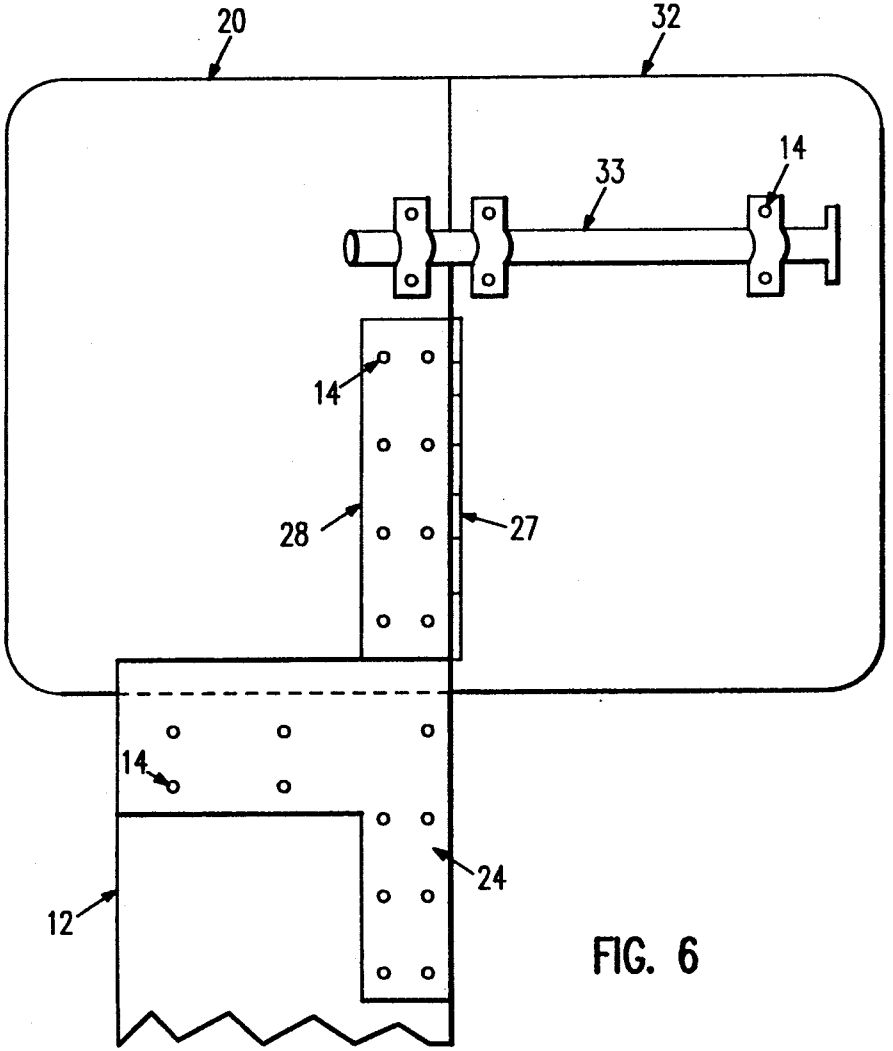
FIG. 6 is a bottom plan view of the left arm of a chair constructed according to the present invention.

Referring now to FIGS. 5A–5C and 6, a preferred attachment means comprises hinge 23 for pivotally mounting the keyboard table 20 to arm 12 is shown. FIG. 6 is a plan view of the keyboard table 20 with mouse table 32 attached from the bottom side illustrating the hinge 23 and mouse table support locking mechanism 33 in place. FIG. 5A illustrates keyboard table-arm hinge 23 affixed to arm 12 and angled keyboard table 20. Keyboard table-arm hinge 23 is attached to chair arm 12 by securing hinge-arm mounting plate 24 to the under side of chair arm 12 with suitable fasteners through the apertures 14 provided in hinge-arm mounting plate 24. If chair arm 12 is constructed of wood for example, suitable fasteners may be wood screws. If chair arm 12 is constructed of metal suitable fasteners may be rivets, bolts or screws. Sufficient numbers of fasteners are used to provide a durable and rigid connection. FIGS. 5B and 5C illustrate hinge member 21 and hinge member 22 in plan view. As shown in FIG. 5B, hinge-arm mounting plate 24 is integrally formed with hinge member 21 of keyboard table-arm hinge 23 and then bent at a 90 degree angle to the hinge member 21 along dashed line 21. When the keyboard table-arm hinge 23 is properly mounted to arm 12, table support lip 26 extends beyond the end of arm 12 and supports angled keyboard table 20 when the latter is pivoted to a horizontal position for use. Hinge-arm mounting plate 24, table support lip 26 and hinge member 21 are constructed of suitable material such as metal plate or heavy sheet metal stock to provide a strong durable attachment means.

Keyboard table-arm hinge piece 23 is similarly affixed to the angled keyboard table 20 with suitable fasteners through the apertures 14 in hingetable mounting plate 28. Hinge-table mounting plate 28 is pivotally affixed to hinge 23 by foldover hinge 27 as shown in FIG. 5C. Hinge-table mounting plate 28 is formed as a separate piece which is then attached by hinge 27 to hinge member 22 of keyboard table-arm hinge 23 to complete the hinge set. The hinge members 21 and 22 are joined with a suitable fastener at pivot point 29 which allows for movement around the pivot. A suitable fastener may be a rivet or bolt for example. The dual action thereby provided allows the keyboard table 20 to be pivoted to a vertical orientation in front of chair arm 12 and also pivoted outwardly to the side of chair arm 12 thus allowing the keyboard table 20 to be folded away when not in use. It is to be understood that the attaching means hereinabove described is illustrative and that any suitable attaching means for permanently or removably affixing the keyboard table 20 to the chair arm 12 and supporting the same thereat is acceptable.

Figure 7B:
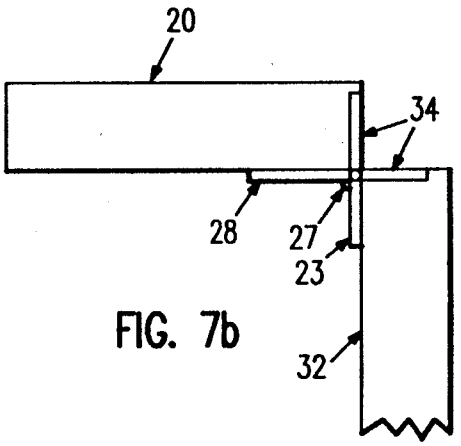
FIG. 7A and 7B are a detail of a hinge means for affixing the optional mouse extension to the keyboard table.
Figure 7A:
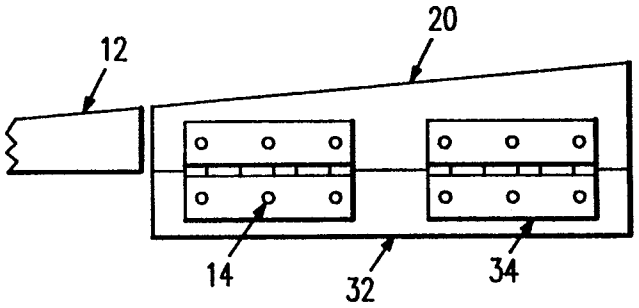

Referring also now to FIGS. 7A and 7B, mouse table 32 is hingedly attached to angled keyboard table 20 by a pair of hinges 34. As shown in FIG. 6, the mouse table 32 is supported by and held in place when extended by mouse table latch 33. Mouse table latch 33 is illustrated as a barrel bolt design as one example of a latch which may be utilized to secure the mouse table 32 to angled keyboard table 20, but is not to be construed as the only suitable latch form. For example, a cam-lock latch may be utilized. The optional mouse table 32 is pivotally attached to the outside edge of the angled keyboard table 20 by any convenient hinge such as the butt hinge 34 as shown. Alternatively, a continuous or "piano" hinge may be used. Hinges 34 are secured to angled keyboard table 20 and mouse table 32 with suitable fasteners through apertures 14 as shown. As described above, fasteners suitable for the table construction material should be utilized.

Referring again to FIGS. 2 and 3, well-known in the art, back angle adjustment knob 5 operates in a conventional screw fashion to bias a cantilevered extension of the back support bracket 7 to alter the angle that the chair back 4 makes with the chair seat 3. The user may select any angle desired for maximum comfort and support by adjustment of the back angle adjustment knob 5.

Figure 8:
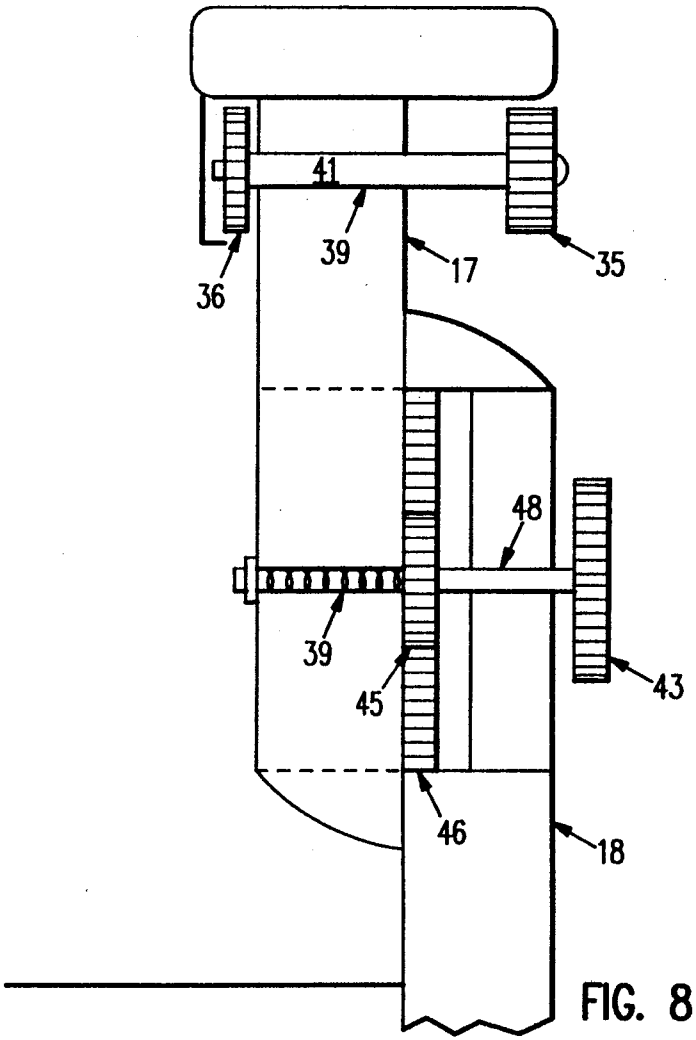
FIG. 8 is a cutaway detail of the arm length and arm height adjustment means.
Figure 9:
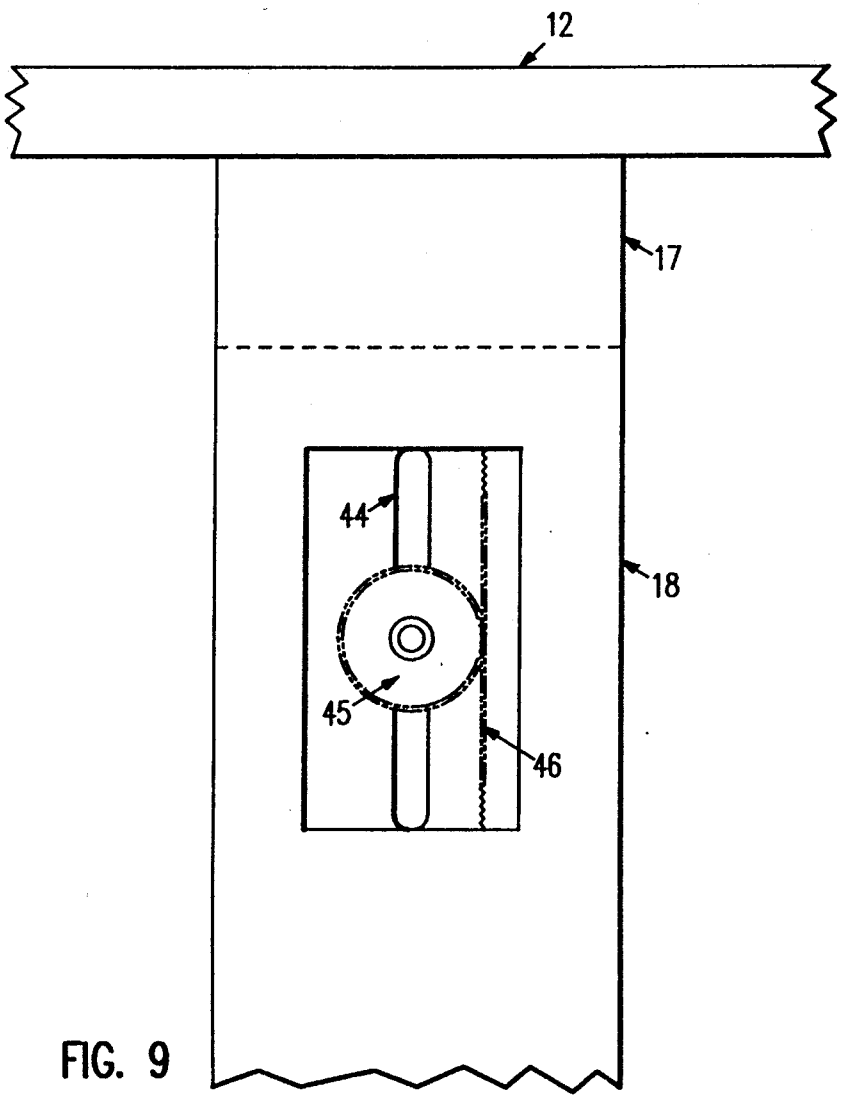
FIG. 9 is a cut away detail of the arm height adjustment means.
Figure 10A:
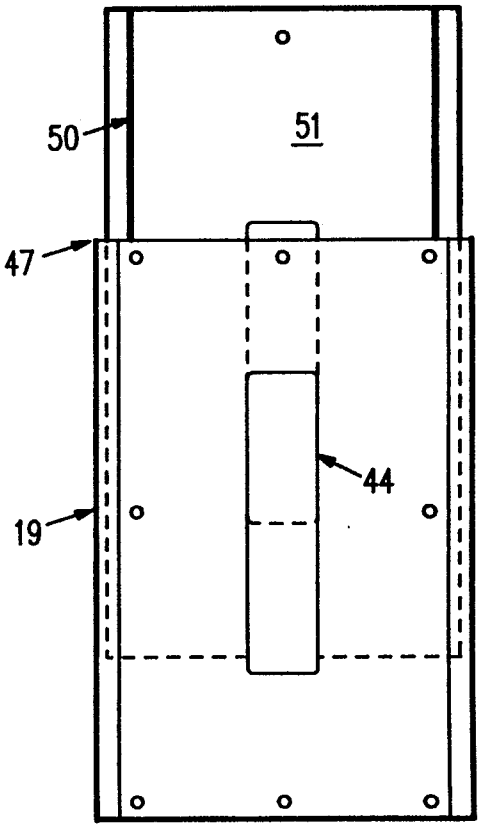
FIG. 10A is a plan view of the chair arm height adjustment guides.

Referring now to FIGS. 8–10, the details of the arm height adjusting means are shown. The shaft 48 connecting height adjustment knob 43 with height adjustment gear 45 passes through a suitable aperture 39 in the arm support upper member 17 as shown in side view in FIG. 8. Height adjustment knob 43 rotates height adjustment gear 45 which engages height adjustment rack 46, thereby moving arm support upper members 17 vertically up or down on adjustment rack 46. The distance of travel is limited by height adjustment slot 44 in the arm support lower member 18. The arm support upper member 17 is held in alignment with arm support lower member 18 during height adjustment by height adjustment guide means 47 including plate 51 attached to the face portion of the arm support upper member 17 and in sliding contact with the arm support lower member 18. Guide plate 49 is attached to the face of arm support lower member 18 in sliding contact with arm support upper member 18. Longitudinal parallel ridges 50 referred to herein as guide tongues are machined in metal arm height adjustment guide plate 51 and aligned with corresponding grooves (not shown) in the contact face of guide plate 49 attached to the arm support lower support member 18. Alternatively, height adjustment guide plates 49 and 51 may be machined into the contacting faces of lower member 18 and upper member 17, respectively, if said members are fabricated from solid metal. Similarly, guide plates 47, 49 may be routed into wooden arm support members. A height adjustment guide means 47 is utilized in each arm support assembly 17, 18. The height adjustment guide means 47 maintain alignment of the mating members of each arm support allowing smooth and parallel movement during height adjustment of the chair arms 12.

Figure 10B:
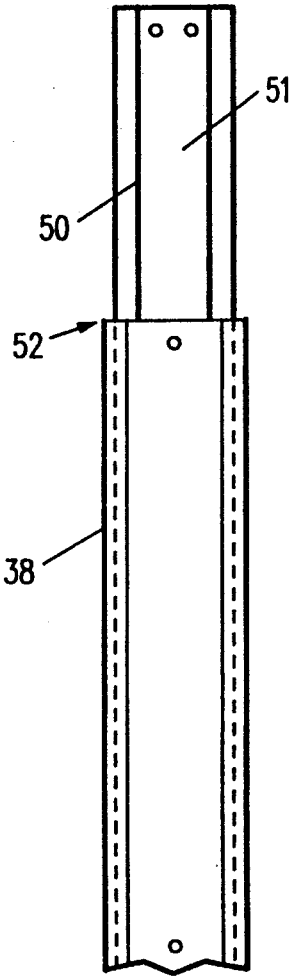
FIG. 10B is a plan view of the chair arm length adjustment guide.
Figure 11:
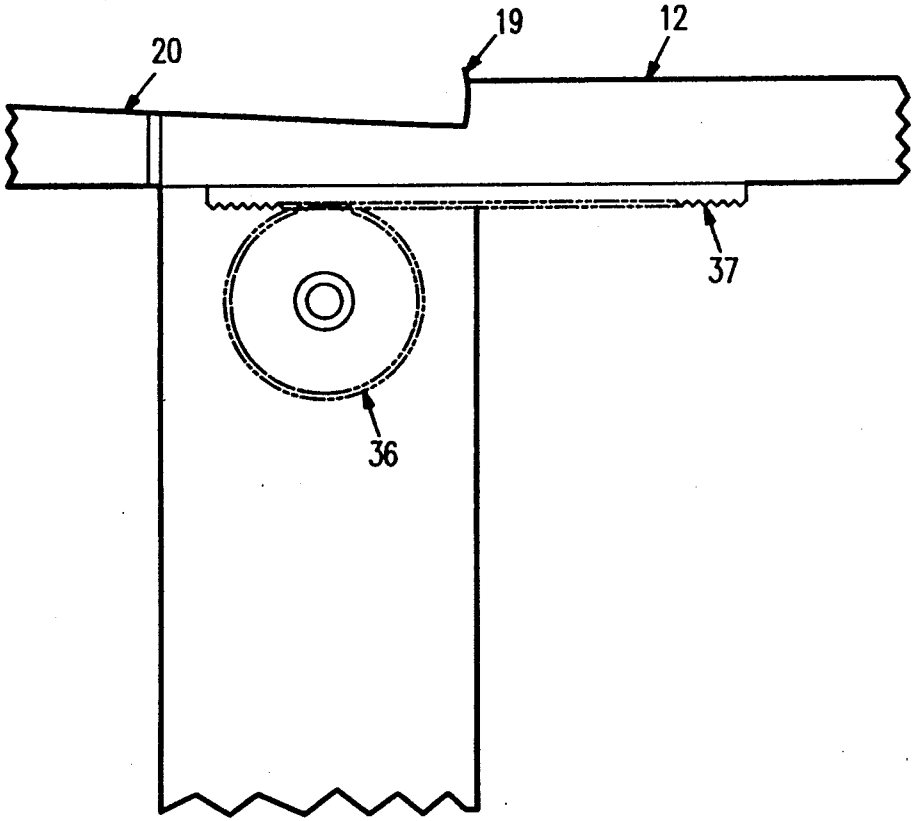
FIG. 11 is a side view in section of the details of the chair arm length adjustment means.

Referring now to FIGS. 10B and 11, arm chair 12 length adjusting means 52 is shown. Similarly to the chair arm height adjustment means described hereinabove, an elongated plate 51 having longitudinal parallel ridges or guide tongues 50 formed therein is fixedly attached to the top of the chair arm upper support members 17 on each side of the chair 1. The chair arm 12 is slidably affixed by a length adjustment guide plate 38 to each plate 51 and thus to each arm support upper member so as to allow for horizontal movement in a front to back direction. Length adjusting gear 36 is turned by arm length adjusting knob 35 and engages length adjustment rack 37. The turning gear 36 is affixed to knob 35 by a shaft which passes through an aperture 41 in arm support upper member 17 of the chair front arm support assembly. Length adjustment guide means 52 may be constructed of suitable materials in the same manner as the height adjustment guide means 47, having guide tongues 50 in the same manner. The guide tongues 50 in the length adjustment guide plate 51 mate with corresponding grooves (not shown) in the opposing face of the length adjustment guide plate 38. FIG. 10B illustrates the two adjustment means in relationship each to the other.

The present invention has been described with reference to a preferred embodiment. However, those skilled in the art and familiar with the disclosure of the present invention will recognize that changes in form and detail may be made without departing from the spirit of the invention, or exceeding the scope of the appended claims.

I claim:

1. In combination with a chair of the type having a back, a seat and a pair of rigid side arms, a pair of support tables for supporting a computer keyboard over the seat in front of a user, each of said support tables pivotally secured to a different one of said rigid side arms, each of said support tables extending inwardly towards one another in spaced relationship with one another, each of said support tables rotatably about a first axis parallel to a rear edge thereof and transverse to said rigid side arm and about a second axis parallel to and adjacent an outside edge of said support table and normal to said first axis, each said support table rotatable about said first axis from a generally horizontal position level with and at the front of said rigid side arm to a vertical position disposed in front of said rigid side arm and rotatable about said second axis from said front vertical position to a position disposed adjacent the outside facing side of said rigid side arm, each said rigid side arm including a contoured keyboard stop formed in the upper surface and at the front end thereof, said pair of support tables and said contoured keyboard stops are adapted to receive and support a computer keyboard when said support tables are disposed in said generally horizontal position, whereby said contoured keyboard stops maintain a desired position of said computer keyboard.

2. The combination as in claim 1 wherein each of said support tables have a wedge-shaped cross-sectional profile, a forward edge thereof being thicker than said rear edge thereof, an upper surface thereof slightly sloped from said forward edge rearwardly toward said chair when said support table is disposed in said generally horizontal position.

3. The combination as in claim 2 wherein each of said contoured keyboard stops comprises a rearwardly sloped indentation formed in the upper surface at the front of each of said rigid side arms, said sloped indentation included a rear shoulder, said computer keyboard abutting said rear shoulder.

4. The combination as in claim 3 wherein the slope of said sloped indentation is in alignment with said slightly sloped upper surface of each said support table.

5. The combination as in claim 3 wherein said rigid side arms are vertically adjustable in height.

6. The combination as in claim 3 wherein said rigid side arms are longitudinally adjustable in length.

7. The combination as in claim 3 wherein said chair comprises a chair base including means adapted for horizontal movement of said chair over a surface.

8. The combination as in claim 3 wherein at least one of said support tables includes generally flat extension member extending from said outside edge for supporting additional computer input devices, said extension member pivotally attached to said support table and rotatable about an axis parallel to said outside edge, said extension member rotatable from a generally horizontally disposed position to a vertically disposed position adjacent to and below said outside edge.

9. The combination as in claim 3 wherein each of said support tables further comprises gripping means disposed along said forward edge for gripping said computer keyboard and maintaining said computer keyboard in a desired position on said support tables.

10. The combination as in claim 9 wherein said gripping means comprises preformed slots in said upper surface for receiving support means attached to the underside of said computer keyboard.

11. The combination as in claim 9 wherein said gripping means comprises a plurality of selectable punchout tabs formed in said upper surface, each of said selectable punch out tabs forming a shaped indentation in said upper surface when removed for receiving support means attached to the underside of said computer keyboard.

12. The combination as in claim 9 wherein said gripping means comprises a sheet of foam rubber having a predetermined width disposed across the width of said support tables adjacent said forward edge of said support tables.

13. The combination as in claim 12 wherein said foam rubber sheet is treated with an antistatic agent.

14. The combination as in claim 1 further comprising rotatable mounting means pivotably mounting each of said support tables to one of said rigid side arms.

15. The combination as in claim 14 wherein said rotatable mounting means comprises hinge means having first and second pivot axis, said first and second pivot axis disposed orthogonal to each other.

16. The combination as in claim 15 wherein said hinge means comprises:

a pair of mounting plates rotatably coupled together along said first pivot axis; and a third mounting plate rotatably coupled to one of said pair of mounting plates along said second pivot axis.

17. The combination as in claim 16 wherein a first one of said pair of mounting plates is fixedly attached to said rigid side arm, said first pivot axis coincident with said first axis, said third plate rotatably coupled to a second one of said pair of mounting plates, said second pivot axis coincident with said axis, said support table fixedly attached to said third mounting plate.

18. The combination as in claim 17 further comprising an extension support table extending from said outside edge of said support table, said extension support table hingeably attached to said outside edge and pivotable about said second axis.

* * * * *